US010460900B2

(12) United States Patent
Seki

(10) Patent No.: US 10,460,900 B2
(45) Date of Patent: Oct. 29, 2019

(54) X-RAY TUBE DEVICE AND X-RAY CT APPARATUS

(71) Applicant: Hitachi, Ltd., Tokyo (JP)

(72) Inventor: Yoshitaka Seki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 217 days.

(21) Appl. No.: 15/527,435

(22) PCT Filed: Oct. 19, 2015

(86) PCT No.: PCT/JP2015/079431

§ 371 (c)(1),
(2) Date: May 17, 2017

(87) PCT Pub. No.: WO2016/080129

PCT Pub. Date: May 26, 2016

(65) Prior Publication Data

US 2018/0330910 A1 Nov. 15, 2018

(30) Foreign Application Priority Data

Nov. 21, 2014 (JP) ..... 2014-236125

(51) Int. Cl.
*H01J 35/10* (2006.01)
*H01J 35/16* (2006.01)

(52) U.S. Cl.
CPC ..... *H01J 35/103* (2013.01); *H01J 35/16* (2013.01); *H01J 2235/08* (2013.01); *H01J 2235/108* (2013.01); *H01J 2235/12* (2013.01)

(58) Field of Classification Search
CPC ..... H01J 35/103; H01J 35/101; H01J 35/16; H01J 2235/08; H01J 2235/1066; H01J 2235/12; H01J 2235/16; H01J 2235/108
See application file for complete search history.

(56) References Cited

U.S. PATENT DOCUMENTS 5,260,983 A * 11/1993 Ono ..... H01J 35/101 378/133
2008/0056450 A1* 3/2008 Joshi ..... H01J 35/101 378/132
2012/0257715 A1* 10/2012 Kobayashi ..... A61B 6/032 378/19

FOREIGN PATENT DOCUMENTS

CN 1592536 A 3/2005
CN 102665560 A 9/2012
(Continued)

OTHER PUBLICATIONS

International Search Report received for PCT Patent Application No. PCT/JP2015/079431, dated May 26, 2016, 6 pages including 2 pages English translation.
(Continued)

*Primary Examiner* — Kiho Kim

(57) ABSTRACT

There is provided an X-ray tube device having a configuration for preventing peeled-off solid lubrication films from scattering in an X-ray tube even when the solid lubrication film peels off a rotary bearing. The X-ray tube device includes: an anode (212) that is irradiated with an electron beam, thereby emitting X-rays; a rotary bearing (304) that rotatably supports the anode (212); a solid lubrication film which is formed on a front surface of the rotary bearing (304) and into which a ferromagnet is mixed from the rotary bearing (304); and an attractor (303) which attracts, with a magnetic force, the solid lubrication film that peels off the rotary bearing (304).

11 Claims, 9 Drawing Sheets

(56) References Cited

FOREIGN PATENT DOCUMENTS

| | | | |
|---|---|---|---|
| JP | S5717547 | A | 1/1982 |
| JP | 57-43349 | A | 3/1982 |
| JP | S5743349 | A | 3/1982 |
| JP | 11-176364 | A | 7/1999 |
| JP | H11176364 | A | 7/1999 |
| JP | 2006-179231 | A | 7/2006 |
| JP | 2014-154497 | A | 8/2014 |
| JP | 2014154497 | A | 8/2014 |
| WO | 2016080129 | A1 | 5/2013 |

OTHER PUBLICATIONS

Office Action for Chinese Application No. 201580057116.1, dated Apr. 3, 2018, 11 pages.

* cited by examiner (a)

(b)

X-RAY TUBE DEVICE AND X-RAY CT APPARATUS

CROSS-REFERENCE TO RELATED APPLICATIONS

This application is a national phase claiming the benefit of and priority to International Patent Application No. PCT/JP2015/079431, entitled "X-RAY TUBE DEVICE AND X-RAY CT DEVICE", filed Oct. 19, 2015, which claims priority to Japanese Patent Application No. 2014-236125, filed Nov. 21, 2014, which are hereby incorporated by reference in their entireties.

TECHNICAL FIELD

The present invention relates to an X-ray tube device and an X-ray computed tomography (CT) apparatus, particularly, to a structure that prevents peeled-off solid lubrication films from a rotary bearing of a rotary anode from scattering.

BACKGROUND ART

An X-ray CT apparatus reconstructs a tomographic image of an object by using projection data obtained at a plurality of angles by causing an X-ray tube device, which irradiates an object with X-rays, and an X-ray detector, which detects an X-ray dosage transmitted through an object as projection data, to rotate around the object, and the apparatus displays the reconstructed tomographic image. The image displayed by the X-ray CT apparatus gives a picture of a shape of an internal organ in the object and is used in diagnostic imaging.

A rotary anode type X-ray tube device, which causes a disk-shaped anode to rotate, is used as the X-ray tube device used in the X-ray CT apparatus. Since the rotary bearing that rotatably supports the anode is used in an evacuated and high-temperature environment, a solid lubrication film made of soft metal as a main component, such as lead or silver, is widely used as a lubricant of the rotary bearing. However, since the solid lubrication film is only mechanically in close contact with front surfaces of bearing balls, an inner ring, and an outer ring that configure the rotary bearing, the film peels off depending on a use state in some cases. When the peeled-off solid lubrication films scatter in an X-ray tube, various problems such as discharge arise.

PTL 1 discloses a structure in which a cap is provided in the vicinity of a rotary bearing in order to reduce scattering of peeled-off solid lubrication films in an X-ray tube.

CITATION LIST

Patent Literature

PTL 1: JP-A-2006-179231

SUMMARY OF INVENTION

Technical Problem

However, also in the structure disclosed in PTL 1, the peeled-off solid lubrication films scatter into the X-ray tube through a gap of the cap in some cases, and it is insufficient to prevent the problem of discharge or the like.

An object of the present invention is to provide an X-ray tube device having a structure for preventing peeled-off solid lubrication films from scattering in an X-ray tube, and to provide an X-ray CT apparatus in which the X-ray tube device is mounted.

Solution to Problem

According to an aspect of the present invention, in order to achieve the object described above, there is provided an X-ray tube device including: an anode that is irradiated with an electron beam, thereby emitting X-rays; a rotary bearing that rotatably supports the anode; a solid lubrication film which is formed on a front surface of the rotary bearing and into which a ferromagnet is mixed from the rotary bearing; and an attractor that attracts, with a magnetic force, the solid lubrication film that peels off the rotary bearing.

In addition, according to another aspect, there is provided an X-ray CT apparatus including: the X-ray tube device; an X-ray detector that is disposed to face the X-ray tube device and detects an X ray transmitted through the object; a rotary disk on which the X-ray tube device and the X-ray detector are mounted and which rotates around the object; an image reconstructing device that reconstructs a tomographic image of the object, based on transmitted X-ray dosages detected at a plurality of angles by the X-ray detector; and an image display device that displays the tomographic image reconstructed by the image reconstructing device.

Advantageous Effects of Invention

According to the present invention, it is possible to provide an X-ray tube device having a structure for preventing the peeled-off solid lubrication films from scattering in an X-ray tube, and it is possible to provide an X-ray CT apparatus in which the X-ray tube device is mounted.

DESCRIPTION OF EMBODIMENTS

Figure 1:
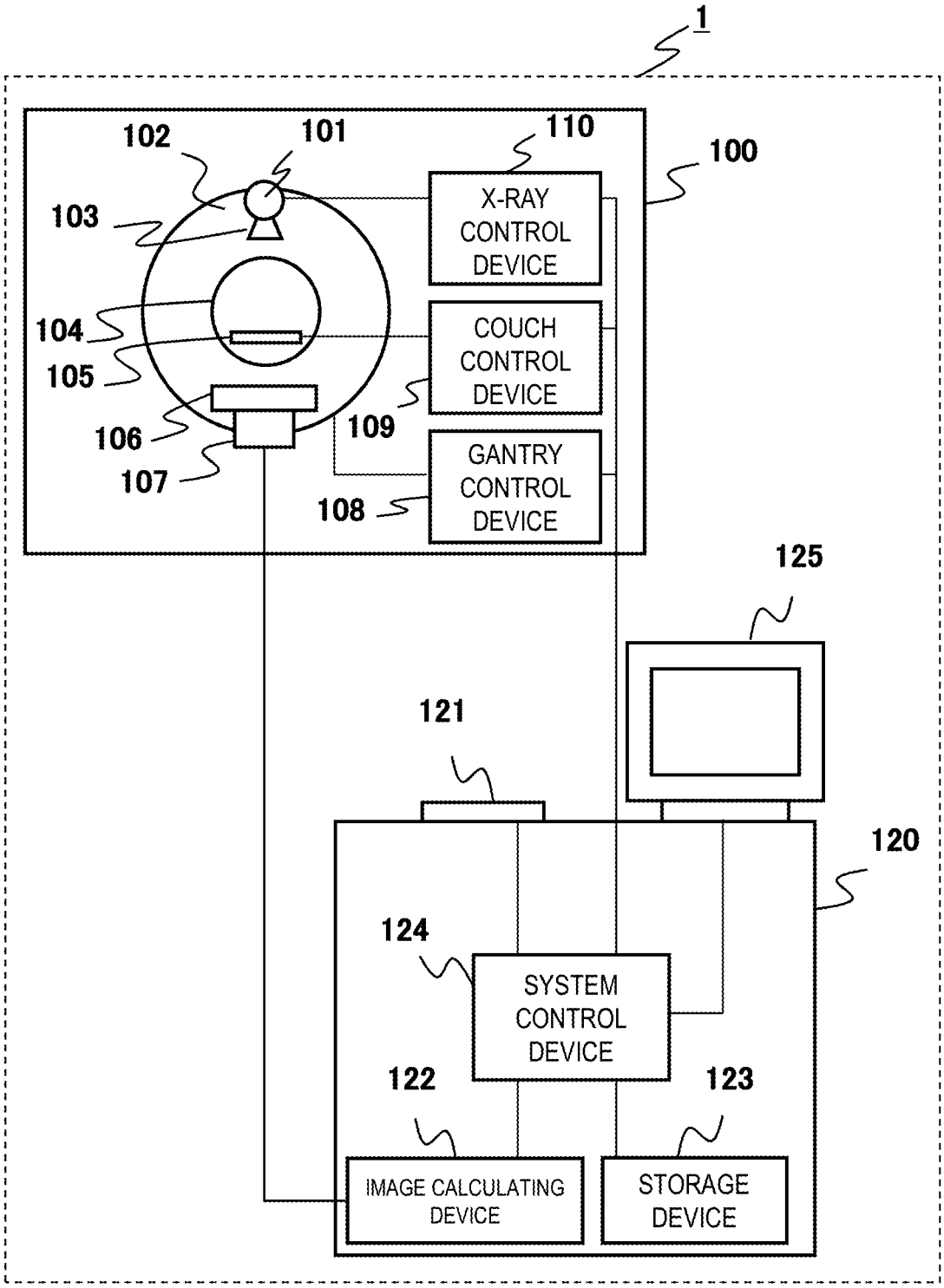
FIG. 1 is a block diagram illustrating an entire configuration of an X-ray CT apparatus of the present invention.

An X-ray tube device according to the present invention includes: an anode that is irradiated with an electron beam, thereby emitting X-rays; a rotary bearing that rotatably supports the anode; a solid lubrication film which is formed on a front surface of the rotary bearing so as to be mixed with a ferromagnet; and an attractor which attracts, with a magnetic force, the solid lubrication film that peels off the rotary bearing.

In addition, a paramagnet is disposed between the attractor and the rotary bearing.

In addition, the attractor contains a permanent magnet and the permanent magnet is disposed at a position having a temperature that does not exceed the Curie temperature of the permanent magnet.

In addition, the X-ray tube device further includes a rotary-member support mechanism that has the rotary bearing and causes the anode to rotate. The permanent magnet is disposed at an exit of the rotary-member support mechanism.

In addition, the attractor contains a ferromagnet that is disposed to be in contact with the permanent magnet.

In addition, the X-ray tube device further includes a rotary-member support mechanism that causes the anode to rotate. The rotary-member support mechanism is provided with a fixed portion having an inner surface to which the rotary bearing is held. The fixed portion has a bottomed cylindrical shape with a bottom surface at one end thereof. The permanent magnet is disposed on the inside bottom surface of the fixed portion.

In addition, the X-ray tube device further includes a rotary-member support mechanism that causes the anode to rotate. The rotary-member support mechanism is provided with a fixed portion that contains a cylindrical paramagnet and a stepped columnar ferromagnet. The rotary bearing is held on the inner surface of the cylindrical paramagnet. A permanent magnet is disposed on or a magnetic coil is wound around an outer circumference of the stepped columnar ferromagnet.

In addition, the X-ray tube device further includes an enclosure that holds the anode in a vacuum atmosphere. The permanent magnet disposed on the outer circumference of the stepped columnar ferromagnet or the magnetic coil wound around the outer circumference thereof is present outside the enclosure.

In addition, a cylindrical ferromagnet is disposed on outer circumferences of the cylindrical paramagnet and the stepped columnar ferromagnet.

In addition, the X-ray tube device further includes a rotary-member support mechanism that causes the anode to rotate. The rotary-member support mechanism is provided with a fixed portion having an inner surface to which the rotary bearing is held. The fixed portion is a paramagnet and a cylindrical ferromagnet is disposed on an outer circumference thereof. A magnetic coil is wound around the outer circumference of the cylindrical ferromagnet.

In addition, the magnetic coil is supplied with power in synchronization with an actuation state of the rotary-member support mechanism.

In addition, the X-ray tube device further includes a rotary-member support mechanism that causes the anode to rotate. The rotary-member support mechanism is provided with a rotary cylinder that has a bottomed cylindrical shape with a bottom surface at one end thereof, that is connected to the anode, that receives a rotational driving force, and that rotates. The attractor contains an annular permanent magnet that is disposed on an inner wall of the rotary cylinder.

An X-ray CT apparatus according to the present invention includes: an X-ray source that irradiates an object with X-rays; an X-ray detector that is disposed to face the X-ray source and detects X-rays transmitted through the object; a rotary disk on which the X-ray source and the X-ray detector are mounted and which rotates around the object; an image reconstructing device that reconstructs a tomographic image of the object, based on a transmitted X-ray dosage detected by the X-ray detector; and an image display device that displays the tomographic image reconstructed by the image reconstructing device. The X-ray source is the X-ray tube device described above.

Hereinafter, a preferred embodiment of the X-ray CT apparatus according to the present invention will be described in detail with reference to accompanying figures. Note that, in the following description and the accompanying figures, configurational components having the same functional configurations are assigned with the same reference signs and the repeated description thereof is omitted.

An entire configuration of an X-ray CT apparatus 1, to which the present invention is applied, is described with reference to FIG. 1. The X-ray CT apparatus 1 includes a scanner gantry 100 and a console 120.

The scanner gantry 100 includes an X-ray tube device 101, a rotary disk 102, a collimator 103, an X-ray detector 106, a data collecting device 107, a couch 105, a gantry control device 108, a couch control device 109, and an X-ray control device 110.

The X-ray tube device 101 is a device that is mounted on the couch 105 and irradiates an object with X-rays. A configuration of the X-ray tube device 101 will be described below with reference to FIG. 2. The collimator 103 is a device that limits an emission range of X-rays with which the X-ray tube device 101 performs irradiation. The rotary disk 102 is provided with an aperture 104 through which the object positioned on the couch 105 passes, with the X-ray tube device 101 and the X-ray detector 106 mounted, and causes the X-ray tube device 101 and the X-ray detector 106 to rotate around the object.

The X-ray detector 106 is disposed to face the X-ray tube device 101 and detects X-rays transmitted through the object, thereby measuring spatial distribution of the transmitted X-rays. Examples of the X-ray detector include a detector in which multiple X-ray detecting elements are arranged in a rotating direction of the rotary disk 102, or a detector in which multiple X-ray detecting elements are arranged in two dimensions of the rotating direction and a rotation-axis direction of the rotary disk 102. The data collecting device 107 collects, as digital data, X-ray dosages detected by the X-ray detector 106. The gantry control device 108 controls rotation of the rotary disk 102. The couch control device 109 controls movement of the couch 105 in vertical, horizontal, and frontward-rearward directions. The X-ray control device 110 controls power that is input to the X-ray tube device 101.

The console 120 includes an input device 121, an image calculating device 122, a display device 125, a storage device 123, and a system control device 124. The input device 121 is to input an object's name, examination date and time, a scanning condition, or the like, and specifically a keyboard or a pointing device. The image calculating device 122 performs calculation processing on measurement data that is transmitted from the data collecting device 107 and reconstructs a tomographic image.

The display device 125 is a device that displays the tomographic image reconstructed by the image calculating device 122, and specifically, a cathode-ray tube (CRT), a liquid crystal display, or the like. The storage device 123 is a device that stores data collected by the data collecting device 107 and image data of a tomographic image reconstructed by the image calculating device 122, and specifically, a hard disk drive (HDD) or the like. The system control device 124 controls the devices, the gantry control device 108, the couch control device 109, and the X-ray control device 110.

The X-ray control device 110 controls power input to the X-ray tube device 101, based on scanning conditions, particularly, such as an X-ray tube voltage or an X-ray tube current, which is input from the input device 121, and thereby the X-ray tube device 101 irradiates an object with X-rays depending on the scanning conditions. The X-ray detector 106 detects, with multiple X-ray detecting elements, X-rays transmitted through the object after irradiation is performed from the X-ray tube device 101, and measures distribution of the transmitted X-rays. The rotary disk 102 is controlled by the gantry control device 108, and rotates, based on the scanning condition, particularly, such as a rotation speed, which is input from the input device 121. The couch 105 is controlled by the couch control device 109, and is actuated, based on the scanning condition, particularly, such as a helical pitch, which is input from the input device 121.

The irradiation with the X-rays from the X-ray tube device 101 and the measurement of the distribution of the transmitted X-rays by the X-ray detector 106 are iterated along with the rotation of the rotary disk 102, and thereby, projection data from various angles is acquired. The acquired projection data from various angles is transmitted to the image calculating device 122. The image calculating device 122 performs a back projection process on the transmitted projection data from the various angles, and thereby the tomographic image is reconstructed. The tomographic image obtained through the reconstruction is displayed by the display device 125.

Figure 2:
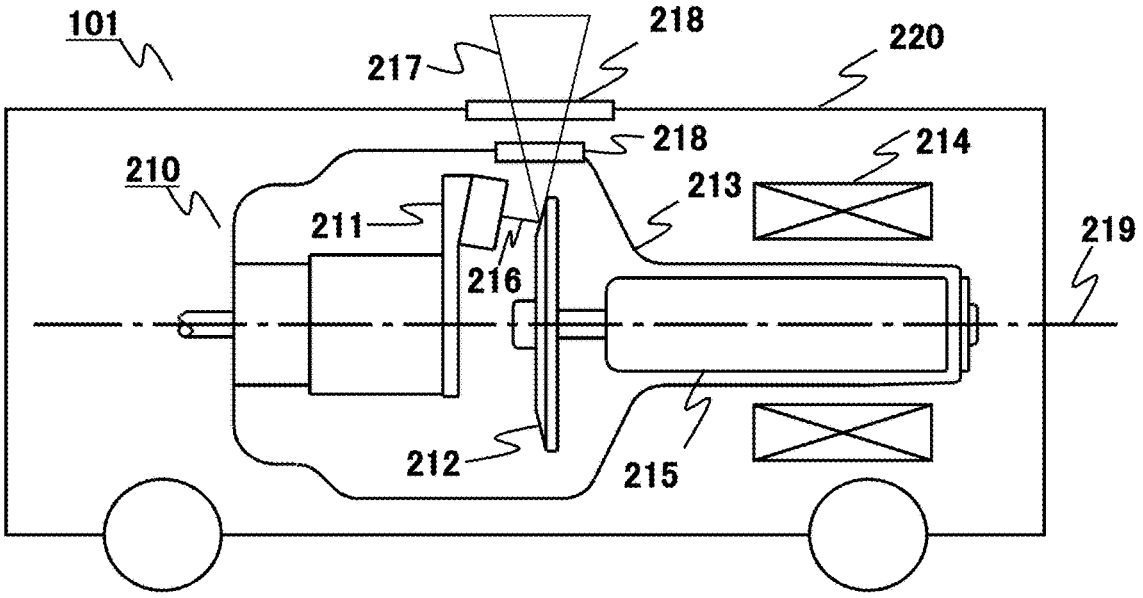
FIG. 2 is a diagram illustrating an entire configuration of an X-ray tube device of the present invention.

A configuration of the X-ray tube device 101 is described with reference to FIG. 2. The X-ray tube device 101 includes an X-ray tube 210 that generates X-rays, and a vessel 220 accommodates the X-ray tube 210.

The X-ray tube 210 includes a cathode 211 that generates electron beams, an anode 212 to which a positive potential is applied with respect to the cathode 211, and an enclosure 213 that holds the cathode 211 and the anode 212 in a vacuum atmosphere.

The cathode 211 includes a filament or a cold cathode and a focusing electrode. The filament is formed of a high-melting-point material, such as tungsten, which is wound to have a coil shape, is heated when currents are applied, and emits electrons. Since the cold cathode is formed of a metal material, such as nickel or molybdenum, which has a sharp-pointed shape, electric fields focus on a cathode surface, and thereby electrons are emitted through field emission. The focusing electrode forms a focusing electric field for focusing the emitted electrons on an X-ray focal point on the anode 212. The filament or the cold cathode has the same potential as that of the focusing electrode.

The anode 212 includes a target and an anode base material. The target is formed of a material, such as tungsten, which has a high atomic number with a high melting point. The electrons emitted from the cathode 211 collide with the X-ray focal point on the target, and thereby X-rays 217 are emitted from the X-ray focal point. The anode base material is formed of a material, such as copper, which has high thermal conductivity and holds the target. The target has the same potential as that of the anode base material.

The enclosure 213 holds the cathode 211 and the anode 212 in the vacuum atmosphere in order to electrically insulate the cathode 211 and the anode 212 from each other. The enclosure 213 is provided with an emission window 218 for emitting the X-rays 217 outside the X-ray tube 210. The emission window 218 is formed of a material, such as beryllium having high X-ray transmittance, which has a low atomic number. The emission window 218 is provided also in the vessel 220 which will be described below. The enclosure 213 has a potential of a ground potential.

The electrons emitted from the cathode 211 are accelerated by the voltage applied between the cathode and the anode, thereby forming electron beams 216. When the electron beams 216 are focused by a focusing field and collide with the X-ray focal point on the target, the X-rays 217 are generated from the X-ray focal point. Energy of the generated X-rays is determined, depending on a voltage, that is, a so-called tube voltage, that is applied between the cathode and the anode. An amount of the generated X-rays is determined, depending on an amount of electrons that are emitted from the cathode, that is, a so-called tube current, and a tube voltage.

A percentage of conversion into the X-rays from the energy of the electron beams 216 is only about 1%, and most of the remaining energy is converted into heat. Since the tube voltage is one hundred and tens of kV and the tube current is hundreds of mA in the X-ray tube device 101 that is mounted on the medical X-ray CT apparatus 1, the anode 212 is heated with a heat quantity of tens of kW. In order to prevent the anode 212 from being overheated and being melted due to such heating, the anode 212 is connected to a rotary-member support mechanism 215 and rotates around a dot-and-dash line 219 in FIG. 2 by driving of the rotary-member support mechanism 215.

In the following description, a rotation axis of the anode 212 is referred to as a rotation axis 219 represented by reference sign 219. The rotary-member support mechanism 215 drives with a magnetic field generated by an exciting coil 214, as a rotational driving force. Since the rotation of the anode 212 causes the X-ray focal point as a portion, with which the electron beams 216 collide, to move, it is possible to maintain a temperature of the X-ray focal point to be lower than a melting point of the target, and it is possible to prevent the anode 212 from being overheated and being melted.

The X-ray tube 210 and the exciting coil 214 are accommodated in the vessel 220. The vessel 220 is filled with insulating oil that electrically insulates the X-ray tube 210 and functions as a cooling medium. The insulating oil, with which the vessel 220 is filled, is guided to a cooler through piping connected to the vessel 220 of the X-ray tube device 101, heat of the insulating oil is dissipated in the cooler, and then the insulating oil returns to the vessel 220 through the piping.

The anode 212 has an average temperature of about 1,000° C. due to the heat generated from the X-ray focal point. Most of the generated heat is dissipated to the enclosure 213 through radiation from a front surface of the anode 212, and the remaining heat flows due to heat conduction to the enclosure 213 through the rotary-member support mechanism 215.

Figure 3:
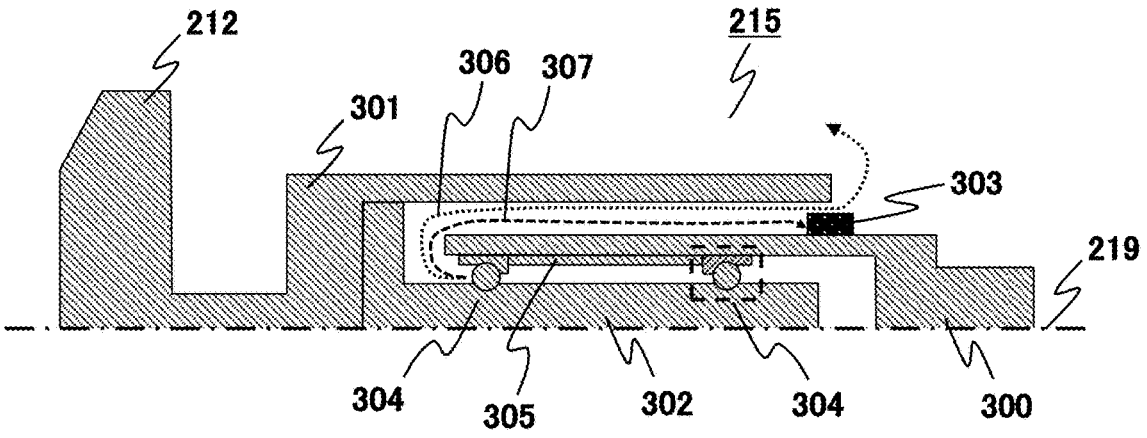
FIG. 3 is a diagram illustrating a first embodiment of the present invention and illustrating a structure on the periphery of an anode of the X-ray tube device.
Figure 3:
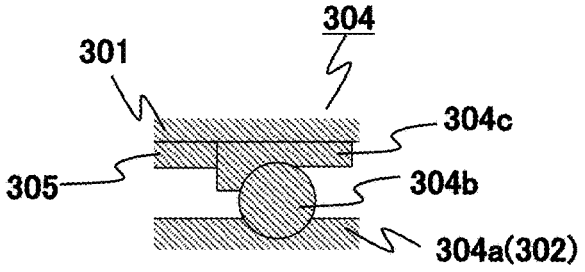

The rotary-member support mechanism 215 connected to the anode 212 is described with reference to FIG. 3. FIG. 3(*a*) is a view illustrating a structure on the periphery of the anode 212, that is, a sectional view taken along the rotation axis 219. In order to simplify the figure, the upper half from the rotation axis 219 is illustrated. The rotary-member support mechanism 215 is connected to one surface opposite to the other surface of the anode 212 which faces the cathode 211, and is provided with a fixed portion 300, a rotary bearing 304, a rotary shaft 302, a rotary cylinder 301, and a spacer 305.

The fixed portion 300 a shape obtained by combining a stepped columnar portion and a bottomed cylindrical shape with a bottom surface at one end, and one end of the columnar portion is supported by the enclosure 213. The rotary bearing 304 is held on the inner surface of the cylinder of the fixed portion 300.

The rotary bearing 304 is a so-called a rolling bearing that rotatably supports the rotary shaft 302 with respect to the fixed portion 300. The rotary bearings 304 are provided at a plurality of positions, for example, at two positions in a direction of the rotation axis 219. A spacer 305 is provided between the plurality of rotary bearings 304. A configuration of the rotary bearing 304 will be described below with reference to FIG. 3(*b*).

The rotary shaft 302 has a stepped columnar shape and is disposed on the inner side of the cylinder of the fixed portion 300.

The rotary cylinder 301 is connected to the rotary shaft 302, and the anode 212 is connected to the rotary cylinder 301.

The rotary cylinder 301 has a bottomed cylindrical shape with a bottom surface at one end, and the fixed portion 300 and the rotary shaft 302 are disposed on the inner side of the rotary cylinder 301. The rotary cylinder 301 receives the magnetic field generated by the exciting coil 214, thereby rotating around the rotation axis 219. Along with the rotation of the rotary cylinder 301, the anode 212 and the rotary shaft 302, which are connected to the rotary cylinder 301, rotate.

The rotary bearing 304 is described with reference to FIG. 3(*b*). FIG. 3(*a*) is an enlarged view of a quadrangle in a dotted line in FIG. 3(*a*). The rotary bearing 304 is provided with an inner ring 304*a*, bearing balls 304*b*, and an outer ring 304*c*. The inner ring 304*a* is an arc of a groove formed on an outer circumference of the rotary shaft 302. The outer ring 304*c* is an annular member provided with an arc of a groove on an inner side thereof. The outer ring 304*c* is concentric with the rotary shaft 302 and is disposed such that the grooves of the inner ring 304*a* and the outer ring 304*c* face each other.

Between the inner ring 304*a* and the outer ring 304*c*, a plurality of bearing balls 304*b* are disposed along the outer circumference of the rotary shaft 302. The inner ring 304*a*, the bearing balls 304*b*, and the outer ring 304*c* are made of high-speed tool steel having high wear resistance even in an environment having a high temperature of hundreds of degrees Celsius. The high-speed tool steel used for the rotary bearing 304 is degaussed. When the steel is insufficiently degaussed, friction increases during the rotation and the increase in the friction is a hindrance to the rotation. In order to further reduce the friction during the rotation, a film of lead, silver, tin or an alloy thereof is formed as a solid lubrication film on front surfaces of the inner ring 304*a*, the bearing balls 304*b*, and the outer ring 304*c*.

The solid lubrication films formed on the surfaces of the inner ring 304*a*, the bearing balls 304*b*, and the outer ring 304*c* peel off in some cases. Discharge in the X-ray tube 210 occurs due to scattering of the peeled-off solid lubrication films. In addition, when the peeled-off solid lubrication films are reattached to the front surfaces of the inner ring 304*a*, the bearing balls 304*b*, and the outer ring 304*c*, friction increases during the rotation. In order to reduce an occurrence of such a problem, such scattering may be prevented even when the solid lubrication films peel off.

Incidentally, a main component of the high-speed tool steel used for the rotary bearing 304 is iron, and the inner ring 304*a*, the outer ring 304*c*, and the bearing balls 304*b* are rubbed against each other. In this manner, iron is mixed into the solid lubrication film. The solid lubrication film, into which the iron as a ferromagnet is mixed, is attracted due to a magnetic force. In other words, a member having the magnetic force is provided at an appropriate position in the X-ray tube 210, and the solid lubrication film is attracted to the member. In this manner, it is possible to prevent the peeled-off solid lubrication films from scattering.

Hereinafter, various embodiments of the X-ray tube device 101 provided with an attractor that attracts the solid lubrication film with the magnetic force will be described.

First Embodiment

A first embodiment is described with reference to FIG. 3. In the embodiment, a magnet 303 as the attractor, which attracts the peeled-off solid lubrication films with the magnetic force, is disposed at a position in an opened end portion of the rotary cylinder 301 in the rotation axis 219 on the outer circumference of the cylinder portion of the fixed portion 300. The position of the opened end portion of the rotary cylinder 301 corresponds to an exit of the peeled-off solid lubrication films from the rotary-member support mechanism 215. The magnet 303 is disposed at the exit from the rotary-member support mechanism 215, and thereby the solid lubrication films scattering in a direction represented by a dotted arrow 306 are attracted to the magnet 303 in a direction represented by a dashed arrow 307. In order to attract the peeled-off solid lubrication films to the magnet 303, the ferromagnet such as iron needs to be mixed into the solid lubrication films. Therefore, the rotary bearing 304 provided with the solid lubrication film on the front surface thereof contains the ferromagnet such as iron.

The magnet 303 is an annular permanent magnet and is caused to slip on the outer circumferential surface of the fixed portion 300. Since the permanent magnet loses ferromagnetic properties at a temperature higher than or equal to the Curie point of the permanent magnet, it is preferable that the magnet 303 is disposed at a position having a temperature that does not exceed the Curie point of the magnet 303. The position, at which the magnet 303 is disposed in FIG. 3(*a*), is a position apart from the anode 212 as a heating portion, and is a position having a relatively low temperature in the X-ray tube 210.

In addition, in a process of manufacturing the X-ray tube device 101, a material having a Curie point higher than the highest temperature of the position, at which the magnet 303 is disposed, may be used for the magnet 303. Specifically, since there is a degassing treatment of heating to a temperature approximating to 300° C. in order to emit occluded gas of a front surface in a tube of the X-ray tube device 101, any one of a samarium-cobalt magnet (having the Curie point of about 800° C.), a neodymium magnet (having the Curie point of about 310° C.), a ferrite magnet (having the Curie point of about 460° C.), and an alnico magnet (having the Curie point of about 850° C.) is used as the magnet 303.

In addition, when the rotary bearing 304 is magnetized due to the magnet 303 disposed in the X-ray tube 210, friction of the rotary bearing 304 increases during the rotation of the anode 212, and the increase in the friction is a hindrance to the rotation. It is preferable that the magnet 303 is disposed at a position apart from the rotary bearing 304. Further, in order to reduce an occurrence of transmission of the magnetic force of the magnet 303 to the rotary bearing 304, it is preferable that a paramagnet such as copper is disposed between the magnet 303 and the rotary bearing 304. In the embodiment, the fixed portion 300 is formed of copper, and thereby the paramagnet is disposed between the magnet 303 and the rotary bearing 304.

In the embodiment as described above, the magnet 303 is disposed at the exit from the rotary-member support mechanism 215. In such a configuration, since the peeled-off solid lubrication films are attracted to the magnet 303, it is possible to prevent the solid lubrication films from scattering. Further, the friction of the rotary bearing 304 does not increase.

Second Embodiment

Figure 4:
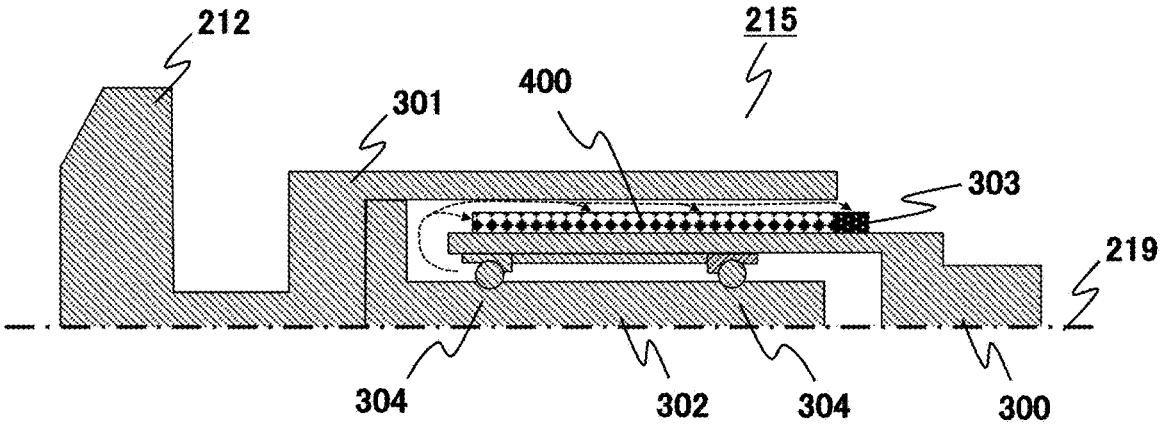
FIG. 4 is a diagram illustrating a second embodiment of the present invention.

A second embodiment is described with reference to FIG. 4. In the embodiment, a magnetic portion 400 is added to the configuration of the first embodiment and the magnetic portion 400 is used as the attractor. Hereinafter, the magnetic portion 400 will be described in detail.

In the rotary anode type X-ray tube device, in order to collect magnetic fields generated by the exciting coil 214, which are used as a rotational driving force of the rotary-member support mechanism 215, the cylindrical magnetic portion 400 is disposed on the outer circumference of the fixed portion 300 in some cases. A ferromagnet such as pure iron is used as the magnetic portion 400. The magnetic portion 400 is disposed on the outer circumference of the fixed portion, thereby the magnetic fields generated by the exciting coil 214 are collected to the magnetic portion 400, and it is possible to cause the rotary cylinder 301 to efficiently rotate.

In the embodiment, in order to use the magnetic portion 400 for the attraction of the peeled-off solid lubrication films, the magnetic portion 400 is brought into contact with the magnet 303. In other words, in the embodiment, the magnetic portion 400 along with the magnet 303 is used as the attractor. The magnet 303 is formed in the same manner as in the first embodiment. Since the magnetic portion 400 is brought into contact with the magnet 303, and thereby the magnetic portion 400 is magnetized, an area of magnetized portions increases, and the peeled-off solid lubrication films are attracted to the magnetic portion 400 or the magnet 303 as in a direction represented by a dotted arrow in FIG. 4. In other words, compared to the first embodiment, it is possible to improve capture rate of the solid lubrication films. In addition, since the fixed portion 300 is formed of copper similar to the first embodiment, the occurrence of transmission of the magnetic force from the magnet 303 and the magnetic portion 400 to the rotary bearing 304 is reduced.

In a case where the magnetic fields generated from the exciting coil 214, which are used as the rotational driving force, are disturbed due to the contact of the magnet 303 with the magnetic portion 400, a correction coil for correcting the magnetic fields may be provided, for example, in the vicinity of the magnet 303.

In the embodiment as described above, the magnet 303 is disposed to come into contact with the magnetic portion 400. In such a configuration, the peeled-off solid lubrication films are attracted to the magnetic portion 400 or the magnet 303, and thus it is possible to prevent the solid lubrication films from scattering.

Third Embodiment

Figure 5:
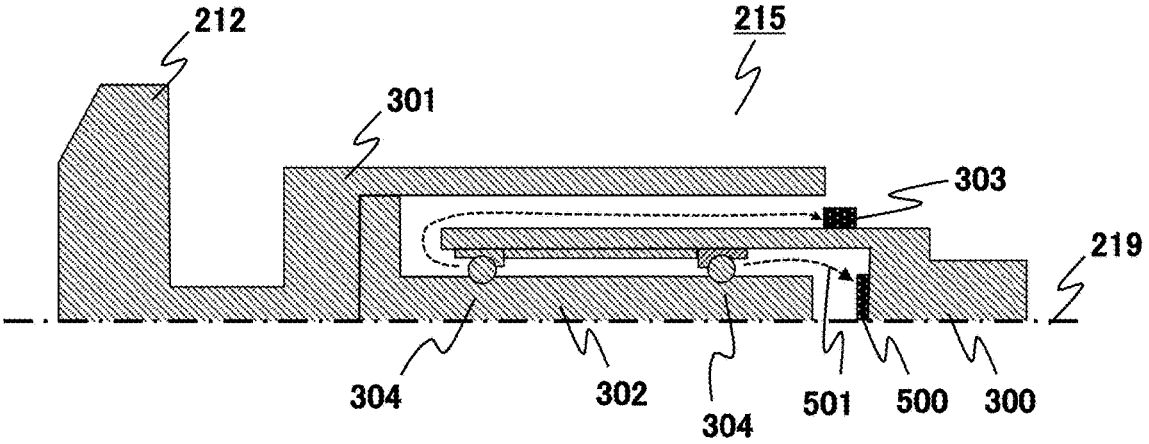
FIG. 5 is a diagram illustrating a third embodiment of the present invention.

A third embodiment is described with reference to FIG. 5. In the embodiment, a magnet 500 is added as the attractor to the configuration of the first embodiment. Hereinafter, the magnet 500 will be described in detail.

In the embodiment, the magnet 500 is provided on the bottom in the fixed portion 300. The magnet 500 is a disk-shaped permanent magnet and, for example, the same permanent magnet as used in the first embodiment is used. The position, at which the magnet 500 is disposed in FIG. 5, is a position apart from the anode 212 as a heating portion, has a relatively low temperature in the X-ray tube 210, and thus has a temperature lower than the Curie point of the permanent magnet used. In addition, the magnet 500 is not in direct contact with the rotary bearing 304, and the fixed portion 300 made of copper is disposed between both thereof.

The peeled-off solid lubrication films not only result in the discharge in the X-ray tube 210, but also the films are reattached to the surfaces of the inner ring 304*a*, the bearing balls 304*b*, or the outer ring 304*c* and thereby an increase in friction of the rotary bearing 304 is caused. The magnet 500 is provided on the bottom in the fixed portion 300 and thereby the solid lubrication films that have peeled off in the cylinder of the fixed portion 300 are attracted to the magnet 500 in a direction represented by a dotted arrow 501 in FIG. 5. Therefore, it is possible to prevent the reattachment to the rotary bearing 304 or the scattering into the X-ray tube 210.

In the embodiment as described above, the magnet 303 is disposed and the magnet 500 is disposed on the bottom of the fixed portion 300. In such a configuration, the peeled-off solid lubrication films are attracted to the magnet 500 and the magnet 303, and thus it is possible to prevent the solid lubrication films from being attached to the rotary bearing 304 or from scattering.

Fourth Embodiment

Figure 6:
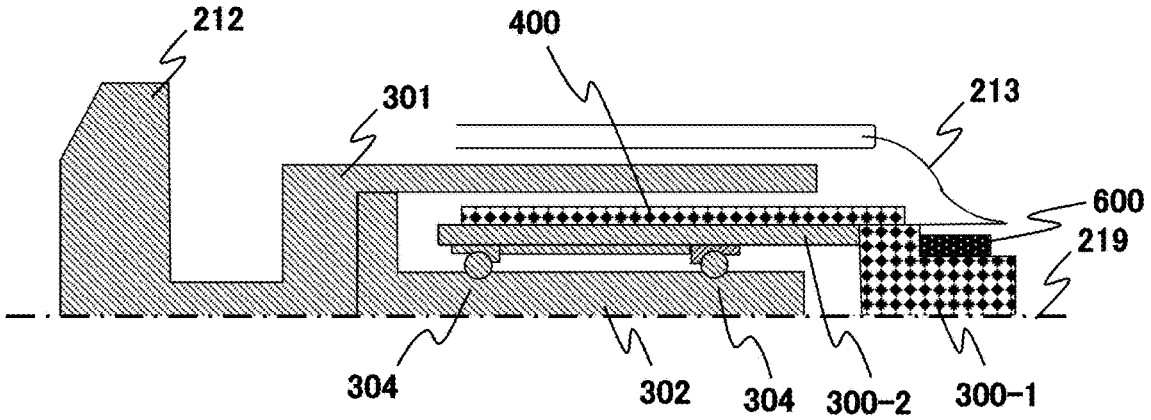
FIG. 6 is a diagram illustrating a fourth embodiment of the present invention.

A fourth embodiment is described with reference to FIG. 6. In the embodiment, apart of the fixed portion 300 is formed of the ferromagnet and the magnet 600 is disposed outside the enclosure 213. The embodiment has such a configuration similar to the configuration of the second embodiment, and thus the fixed portion 300 and a magnet 600, which are differences from the second embodiment, are described in detail.

In the embodiment, the fixed portion 300 is configured to have a fixed iron portion 300-1 and a fixed copper portion 300-2.

The fixed iron portion 300-1 is formed of a ferromagnet such as pure iron, and has a stepped columnar shape. An annular magnet 600 is disposed on the outer circumference of a columnar portion having a diameter smaller than a diameter of the fixed iron portion 300-1 outside the enclosure 213. Except for the position at which the magnet 600 is attached, the magnet 600 has the same configuration as that of the magnet 300 of the first embodiment.

The fixed copper portion 300-2 is formed of a paramagnet such as copper, and has a cylinder shape. A cylindrical magnetic portion 400 is disposed on outer circumferences of the fixed iron portion 300-1 and the fixed copper portion 300-2. Except for a length of the rotation axis 219, the magnetic portion 400 has the same configuration as that of the second embodiment. In the embodiment, since the fixed iron portion 300-1 and the fixed copper portion 300-2 are disposed on inner surfaces of the magnetic portion 400, the magnetic portion 400 may be a member that connects both of the portions.

According to such a configuration, the magnetic force of the magnet 600 is transmitted to the fixed iron portion 300-1, which is in contact with the magnet 600, and the magnetic portion 400 that is in contact with the fixed iron portion 300-1. Therefore, the fixed iron portion 300-1 and the magnetic portion 400 function as the attractors in the X-ray tube 210. The peeled-off solid lubrication films are attracted to the fixed iron portion 300-1 or the magnetic portion 400.

Therefore, it is possible to prevent the reattachment to the rotary bearing 304 or the scattering into the X-ray tube 210.

In addition, the magnet 600, the fixed iron portion 300-1, the magnetic portion 400 which are magnetized, and the rotary bearing 304 are not in direct contact with each other, but the fixed copper portion 300-2 is disposed therebetween. In other words, an occurrence of magnetization of the rotary bearing 304 due to the magnetic force of the magnet 600 is reduced, and the friction of the rotary bearing 304 does not increase.

Further, since the magnet 600 is disposed outside the enclosure 213, the magnet 600 may be attached after the degassing treatment in which the X-ray tube 210 is heated, it is easy to manufacture the X-ray tube device 101, compared to that in the first-to-third embodiments. In addition, since it is possible to cool the magnet 600 by using the insulating oil, it is possible to use permanent magnet having the Curie point, compared to the first to third embodiments.

In the embodiment described above, the fixed iron portion 300-1 as a part of the fixed portion 300 is formed of the ferromagnet, and the magnet 600 is provided on the fixed iron portion 300-1 outside the enclosure 213. Further, the magnetic portion 400 is disposed on the outer circumference of the fixed iron portion 300-1 in the enclosure 213. In such a configuration, the peeled-off solid lubrication films are attracted to the fixed iron portion 300-1 and the magnetic portion 400, and thus it is possible to prevent the solid lubrication films from being attached to the rotary bearing 304 or from scattering.

Fifth Embodiment

Figure 7:
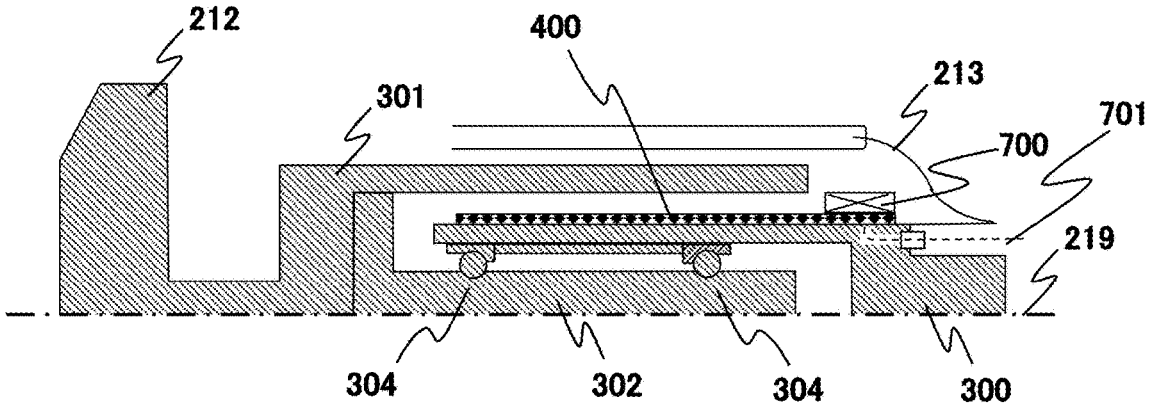
FIG. 7 is a diagram illustrating a fifth embodiment of the present invention.

A fifth embodiment is described with reference to FIG. 7. In the embodiment, instead of the permanent magnet used in the second embodiment, an electromagnet is used as the attractor. Hereinafter, a magnetic coil 700 and the magnetic portion 400 that configure the electromagnet which is a difference from the second embodiment will be described in detail.

In the embodiment, the magnetic coil 700 is wound around the magnetic portion 400 disposed on the outer circumference of the fixed portion 300. The magnetic portion 400 is formed of the ferromagnet such as pure iron which has a cylindrical shape similar to the second embodiment. It is preferable that the magnetic coil 700 is formed of a wire of copper or the like which is coated and insulated with ceramic or the like and has a configuration in which gas is not generated in vacuum. Power is supplied to the magnetic coil 700 through a power supply line 701.

In addition, the power supply line 701 is connected to the inside and the outside of the enclosure 213 via a hermetic seal or the like. Since the magnetic coil 700 and the magnetic portion 400 have the same potential, an isolation transformer is connected to the power supply line 701 and a power source in a case where the magnetic portion 400 has a potential difference of about tens of kV with respect to a ground potential. There is no need to provide the isolation transformer in a so-called anode ground type X-ray tube device in which a potential of the anode 212 is the ground potential.

When power is supplied from the power supply line 701 to the magnetic coil 700, the magnetic portion 400 is magnetized and the peeled-off solid lubrication films are attracted to the magnetic portion 400. When the solid lubrication films are attracted to the magnetic portion 400, it is possible to prevent the solid lubrication films from scattering.

There is no need to perform power supply all the time to the magnetic coil 700, and the power supply may be performed, depending on an operation state of the rotary-member support mechanism 215. In other words, the system control device 124 may synchronize the power supply to the magnetic coil 700 with power supply to the exciting coil 214. Since such an operation causes the peeled-off solid lubrication films to be attracted to the magnetic portion 400 while the rotary bearing 304 rotates, it is possible to prevent problems from arising due to the reattachment of the solid lubrication films to the rotary bearing 304, and it is possible to save power supply to the magnetic coil 700.

Sixth Embodiment

Figure 8:
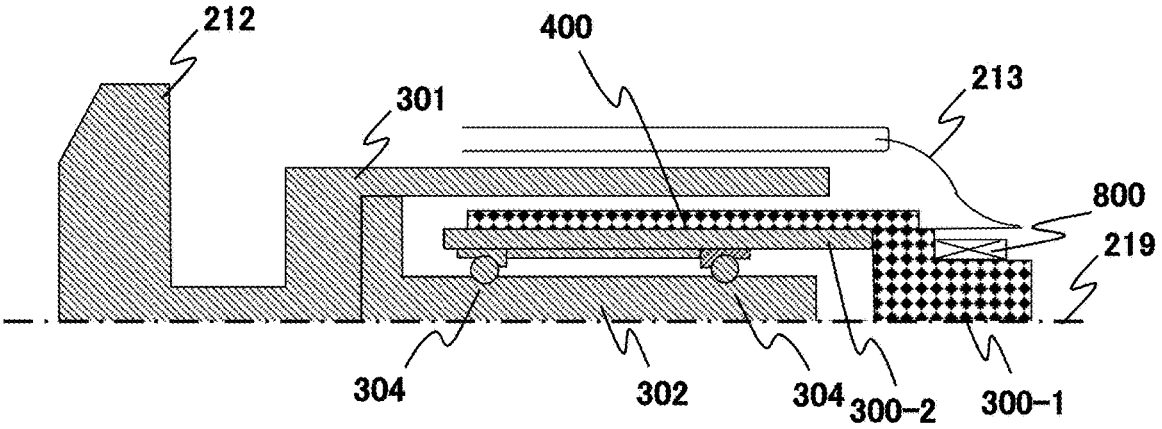
FIG. 8 is a diagram illustrating a sixth embodiment of the present invention.

A sixth embodiment is described with reference to FIG. 8. In the embodiment, instead of the permanent magnet used in the fourth embodiment, an electromagnet is used as the attractor. Hereinafter, a magnetic coil 800 that configures the electromagnet which is a difference from the fourth embodiment will be described in detail.

In the embodiment, a magnetic coil 800 is wound around the outer circumference of the columnar portion having the diameter smaller than the diameter of the fixed iron portion 300-1 outside the enclosure 213. The fixed iron portion 300-1 is formed of the ferromagnet such as pure iron, similar to the fourth embodiment. The magnetic coil 800 may be formed of a wire of copper or the like which is coated and insulated with ceramic or the like or the wire may be insulated by using a resin such as enamel, vinyl, or the like. Since the magnetic coil 800 and the fixed iron portion 300-1 have the same potential, an isolation transformer is connected to the magnetic coil 800 and a power source in a case where the fixed iron portion 300-1 has a potential difference of about tens of kV with respect to the ground potential. There is no need to provide the isolation transformer in a so-called anode ground type X-ray tube device in which a potential of the anode 212 is the ground potential.

The power supply to the magnetic coil 800 may be performed all the time, or the system control device 124 may synchronize the power supply with power supply to the exciting coil 214, similar to the fifth embodiment. The power supply is synchronized with the power supply to the exciting coil 214, and thereby the peeled-off solid lubrication films are attracted to the magnetic portion 400 while the rotary bearing 304 rotates. Therefore, it is possible to prevent problems from arising due to the reattachment of the solid lubrication films to the rotary bearing 304, and it is possible to save power supply to the magnetic coil 800.

Seventh Embodiment

Figure 9:
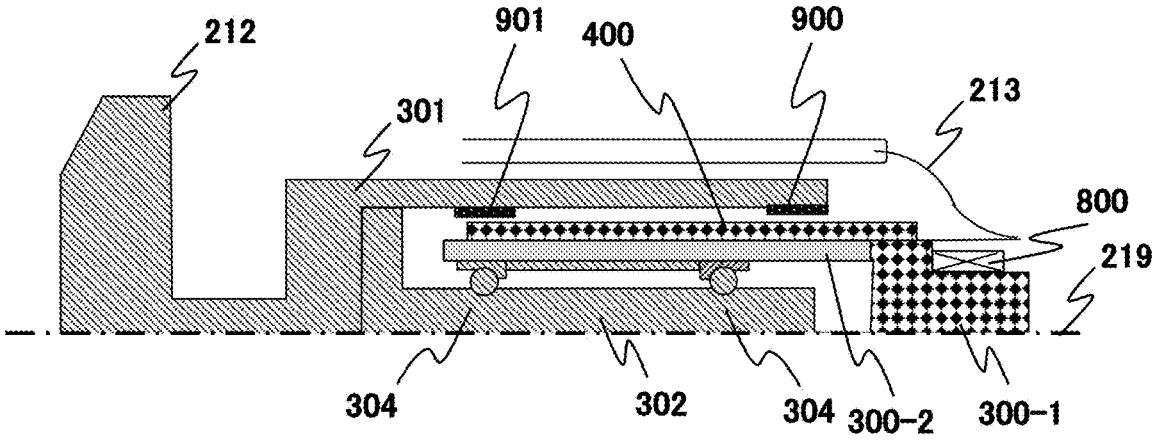
FIG. 9 is a diagram illustrating a seventh embodiment of the present invention.

A seventh embodiment is described with reference to FIG. 9. In the embodiment, a magnet 900 and a magnet 901 are added as the attractor to the configuration of the sixth embodiment. Hereinafter, the magnet 900 and the magnet 901 will be described in detail.

In the embodiment, the magnet 900 and the magnet 901 are provided on an inner wall of the rotary cylinder 301. The magnet 900 and the magnet 901 are a disk-shaped permanent magnet and, for example, the same permanent magnet as used in the first embodiment is used.

In such a configuration, since portions, to which the peeled-off solid lubrication films are attracted, are increased more than those in the sixth embodiment, it is possible to improve capture rate of the solid lubrication films. In addition, the solid lubrication films attracted to the magnet 900 and the magnet 901 are pressed on the inner wall of the rotary cylinder 301 due to a centrifugal force of the rotating rotary cylinder 301.

In the embodiment, a case where two magnets of the magnet 900 and the magnet 901 are provided is described; however, any one magnet of the magnet 900 and the magnet 901 may be provided, or three or more magnets may be provided on the inner surface of the rotary cylinder 301. It is desirable to dispose the magnet at a position at which the magnetic fields generated from the exciting coil 214 are not disturbed. In a case where the magnet is disposed at a position at which the magnetic fields generated from the exciting coil 214 are disturbed, a correction coil for correcting the magnetic fields may be provided.

As described above, a plurality of embodiments are described; however the invention is not limited to the embodiments described above. For example, in the third embodiment, the magnet 500 may not be the permanent magnet, but may be formed of the electromagnets. In the case where the magnet 500 is formed of the electromagnet, power supply may be synchronized with the power supply to the exciting coil 214 similar to the fifth embodiment, and the magnet 500 may be actuated. In addition, in the fourth embodiment, the magnet 600 may be disposed on the outer circumference of the magnetic portion 400.

In addition, the embodiment described above may be appropriately combined. For example, the magnet 900 provided on the inner wall of the rotary cylinder 301 described in the seventh embodiment may be used by being combined with any one of the first to fifth embodiments.

REFERENCE SIGNS LIST

1: X-ray CT apparatus
100: scanner gantry
101: X-ray tube device
102: rotary disk
103: collimator
104: aperture
105: couch
106: X-ray detector
107: data collecting device
108: gantry control device
109: couch control device
110: X-ray control device
120: console
121: input device
122: image calculating device
123: storage device
124: system control device
125: display device
210: X-ray tube
211: cathode
212: anode
213: enclosure
214: exciting coil
215: rotary-member support
216: electron beam
217: X-ray
218: emission window
219: rotation axis
220: vessel
300: fixed portion
300-1: iron fixed portion
300-2: copper fixed portion
301: rotary cylinder
302: rotary shaft
303: magnet
304: rotary bearing
304*a*: inner ring
304*b*: bearing ball
304*c*: outer ring
305: spacer
306: dotted arrow
307: dashed arrow
400: magnetic portion
500: magnet
501: dotted arrow
600: magnet
700: magnetic coil
701: power supply line
800: magnetic coil
900: magnet
901: magnet

The invention claimed is:

1. An X-ray tube device comprising:
an anode that is irradiated with an electron beam, thereby emitting X-rays;
a rotary bearing that rotatably supports the anode;
a solid lubrication film which is formed on a front surface of the rotary bearing so as to be mixed with a ferromagnet; and
an attractor that attracts, with a magnetic force, the solid lubrication film that peels off the rotary bearing;
wherein the attractor contains a permanent magnet and the permanent magnet is disposed at a position having a temperature that does not exceed the Curie temperature of the permanent magnet; and
wherein the attractor contains a ferromagnet that is disposed to be in contact with the permanent magnet.

2. The X-ray tube device according to claim 1,
wherein a paramagnet is disposed between the attractor and the rotary bearing.

3. The X-ray tube device according to claim 1, further comprising:
a rotary-member support mechanism that has the rotary bearing and causes the anode to rotate,
wherein the permanent magnet is disposed at an exit of the rotary-member support mechanism.

4. The X-ray tube device according to claim 1, further comprising:
a rotary-member support mechanism that causes the anode to rotate,
wherein the rotary-member support mechanism is provided with a fixed portion having an inner surface to which the rotary bearing is held,
wherein the fixed portion has a bottomed cylindrical shape with a bottom surface at one end thereof, and
wherein the permanent magnet is disposed on the inside bottom surface of the fixed portion.

5. The X-ray tube device according to claim 1, further comprising:
a rotary-member support mechanism that causes the anode to rotate,
wherein the rotary-member support mechanism is provided with a fixed portion that contains a cylindrical paramagnet and a stepped columnar ferromagnet,
wherein the rotary bearing is held on the inner surface of the cylindrical paramagnet, and
wherein a permanent magnet is disposed on or a magnetic coil is wound around an outer circumference of the stepped columnar ferromagnet.

6. The X-ray tube device according to claim 5, further comprising:

an enclosure that holds the anode in a vacuum atmosphere, wherein the permanent magnet disposed on the outer circumference of the stepped columnar ferromagnet or the magnetic coil wound around the outer circumference thereof is present outside the enclosure.

7. The X-ray tube device according to claim 5, wherein a cylindrical ferromagnet is disposed on outer circumferences of the cylindrical paramagnet and the stepped columnar ferromagnet.

8. The X-ray tube device according to claim 1, further comprising:

a rotary-member support mechanism that causes the anode to rotate, wherein the rotary-member support mechanism is provided with a fixed portion having an inner surface to which the rotary bearing is held, wherein the fixed portion is a paramagnet and a cylindrical ferromagnet is disposed on an outer circumference thereof, and wherein a magnetic coil is wound around the outer circumference of the cylindrical ferromagnet.

9. The X-ray tube device according to claim 8, wherein the magnetic coil is supplied with power in synchronization with an actuation state of the rotary-member support mechanism.

10. The X-ray tube device according to claim 1, further comprising:

a rotary-member support mechanism that causes the anode to rotate, wherein the rotary-member support mechanism is provided with a rotary cylinder that has a bottomed cylindrical shape with a bottom surface at one end thereof, that is connected to the anode, that receives a rotational driving force, and that rotates, and wherein the attractor contains an annular permanent magnet that is disposed on an inner wall of the rotary cylinder.

11. An X-ray CT apparatus comprising:

an X-ray source that irradiates an object with X-rays;

an X-ray detector that is disposed to face the X-ray source and detects X-rays transmitted through the object;

a rotary disk on which the X-ray source and the X-ray detector are mounted and which rotates around the object;

an image reconstructing device that reconstructs a tomographic image of the object, based on a transmitted X-ray dosage detected by the X-ray detector; and an image display device that displays the tomographic image reconstructed by the image reconstructing device, wherein the X-ray source is the X-ray tube device according to claim 5.

* * * * *